United States Patent [19]

Crossman et al.

[11] Patent Number: 4,716,699

[45] Date of Patent: Jan. 5, 1988

[54] WALL PANELS WITH SINGLE LOAD-BEARING CONNECTOR POSTS

[75] Inventors: Philip E. Crossman, Holland; Terry L. Mitchell, Jenison, both of Mich.

[73] Assignee: Rostec Industries, San Jose, Calif.

[21] Appl. No.: 910,458

[22] Filed: Sep. 23, 1986

Related U.S. Application Data

[63] Continuation-in-part of Ser. No. 820,408, Jan. 17, 1986, abandoned.

[51] Int. Cl.[4] ..... E04H 1/00

[52] U.S. Cl. ..... 52/239; 52/36; 52/282; 248/243

[58] Field of Search ..... 52/238.1, 239, 243, 52/36, 282; 248/243

[56] References Cited

U.S. PATENT DOCUMENTS

| | | | |
|---|---|---|---|
| 2,994,413 | 8/1961 | Levy et al. | 52/36 |
| 3,513,606 | 5/1970 | Jones | 52/243 X |
| 3,762,116 | 10/1976 | Anderson et al. | 52/239 |
| 3,877,191 | 5/1975 | Munsey | 52/632 |
| 3,971,182 | 7/1976 | Donahue et al. | 52/282 |
| 4,104,838 | 8/1978 | Hage et al. | 52/239 |
| 4,219,175 | 8/1980 | Harig | 248/243 X |
| 4,567,698 | 2/1986 | Morrison | 52/36 |
| 4,571,907 | 2/1986 | De Fouw et al. | 52/239 |

*Primary Examiner*—Carl D. Friedman

*Attorney, Agent, or Firm*—Thomas Schneck

[57] ABSTRACT

Modular wall panels and ancillary furnishings and fixtures, such as shelves and cabinets, having a single load-bearing connector post between two coplanar panel members. The panel members engage apertures in the side walls of the connector post. The front and back walls of the connector post are vertically slotted with a width dimension to support hooks from two brackets within each slot, one from the left and one from the right sides of adjacent shelves, desk surfaces or cabinets. Thus, the connector posts directly support all of the system load without lateral force transfer from intermediate load bearing members. The load is transmitted vertically downward to a support surface, usually a floor. At intersections of non coplanar panels, a connector post terminates each planar panel run and is joined to a non load-bearing intersection post at a side wall of each connector post.

15 Claims, 24 Drawing Figures

85
67
65
103
57
43
41
37
121
77
71
31
75
63
115
45
101
119
39
117

WALL PANELS WITH SINGLE LOAD-BEARING CONNECTOR POSTS

CROSS REFERENCE TO RELATED APPLICATION

This application is a continuation-in-part of prior application Ser. No. 820,408, filed Jan. 17, 1986, abandoned.

TECHNICAL FIELD

The invention relates to a wall panel system and more particularly to apparatus for supporting a number of coplanar and non-coplanar wall panels.

BACKGROUND ART

The chief use for portable wall panel systems is dividing office space. A typical wall panel assembly utilizes a number of components to connect and support one panel to a second panel. Each panel requires an edge connector, usually a channel, and it is only after an edge channel has been connected that a panel may be attached to a post which links the separate panels in a non-load-bearing manner. A pair of such posts is then connected to a load bearing post. Thus, most panel-to-panel connections require two non-load-bearing posts and a load-bearing support post. Assemblies having a multitude of connecting components can be very costly to purchase and time-consuming to assemble. In addition, many times the connecting hardware is left visible, resulting in a less aesthetically pleasing structure.

U.S. Pat. No. 4,571,907 to DeFouw et al. shows a panel system having a double connector post suspension system. Brackets atop the posts anchor adjacent panels, as well as intersection posts.

U.S. Pat. No. 4,567,698 to Morrison shows a panel system having a double connector post suspension system.

U.S. Pat. Nos. 3,971,182 to Donahue et al. and 4,104,838 to Hage et al. describe portable wall assemblies which require that panel members be fitted with a rectangular edge channel at each vertical side edge. Panel connections are made by inserting hook-type mounting clips, projecting from the upper and lower portions of the edge channels, into the interior of a support post. The support post may be round or square, but in either case the post contains cavities which receive the mounting clips of the edge channel. A connector plug or retainer in the top of the support post is manipulated. Flexible sealing inserts are wedged between the panels and the support post to provide privacy from one side of the assembly to the other.

Similar in construction to the above-described patents, U.S. Pat. Nos. 3,762,116 to Anderson et al. and 3,877,191 to Munsey disclose panel assemblies in which each panel member insert must first be equipped with at least one non-load-bearing edge channel before the panel member may be attached to a support post. Once again, all panel-to-panel connections require two edge channels and a support post. The support post is a hollow tubular post having panel connector adaptors secured at each end to receive the hook-type mounting clips of an edge channel.

A problem found in the prior art is that a multiplicity of slotted linear structures had to be provided to support ancillary structures, such as shelves, bookcases, cantilevered surfaces and the like. Often, the load carried by these structures had to be laterally transferred to a support post. The resulting structure is mechanically unstable and not appreciably sturdy.

It is an object of the present invention to provide a strong mechanically stable support system for modular wall panels and ancillary structures cantilevered from the vicinity of the panels. It is a further object to provide a wall panel system which is aesthetically pleasing and is substantially without visible gaps between connecting components.

DISCLOSURE OF THE INVENTION

The above objects have been met by a wall panel system which uses a single load-bearing connector post to link two coplanar panel members. The panels abut opposed walls of the connector post and because the post partially fits into recesses of the panel members, only a small portion of the post is exposed. The small exposed portion of each connector post has a linear array of slots, each slot accommodating a pair of tangs or hooks from different, but adjacent articles to be supported in cantilever fashion. Correspondingly, the hooks of brackets cantilevering supported items, such as shelves, surfaces, cabinets, book cases and the like are made thin enough, or the slot wide enough, so that a pair will fit into one slot. This allows left and right ends of adjacent supported items to receive vertical support directly from a load-bearing support post without lateral force transfer.

The side walls of the connector post that abut panel members each contain a connector post aperture. The post apertures are near the bottom of the connector posts and match the height of lower connector flanges on the panel members. The lower connector flanges, like the upper flanges, have downwardly extending segments. When the downwardly extending segment of a lower flange is slipped into a post aperture, increased support is given to the junction of panel member and connector post.

A panel member may be locked in place by a securing arrangement which applies a downward pressure to the upper connector flange at the area of contact with a U-shaped bracket at the top of the post. This arrangement prevents the panel member from being unintentionally disengaged from the connector post.

For those instances in which a wall structure contains non-coplanar panel members at right angles to each other, the connector posts near the right angle junction of the panel members link and support these panel members to a non-load-bearing intersection member, usually having a rectangular cross section. An upper intersection flange is mounted atop the intersection member and the flange has a downwardly extending segment for overlapping engagement with the U-shaped bracket of each connector post. A lower intersection flange is affixed to the intersection post at a height for engagement with a connector post aperture.

An advantage of the present invention is that the load of both panels and ancillary structures, such as shelves, is supported by beam-like connector posts. Half-width hooks or tangs or double-width slots in each post accommodate supported structures in a manner such that weight is transmitted vertically downwardly and without a lateral force component, as is typical in the prior art.

BEST MODE FOR CARRYING OUT THE INVENTION

Figure 1:
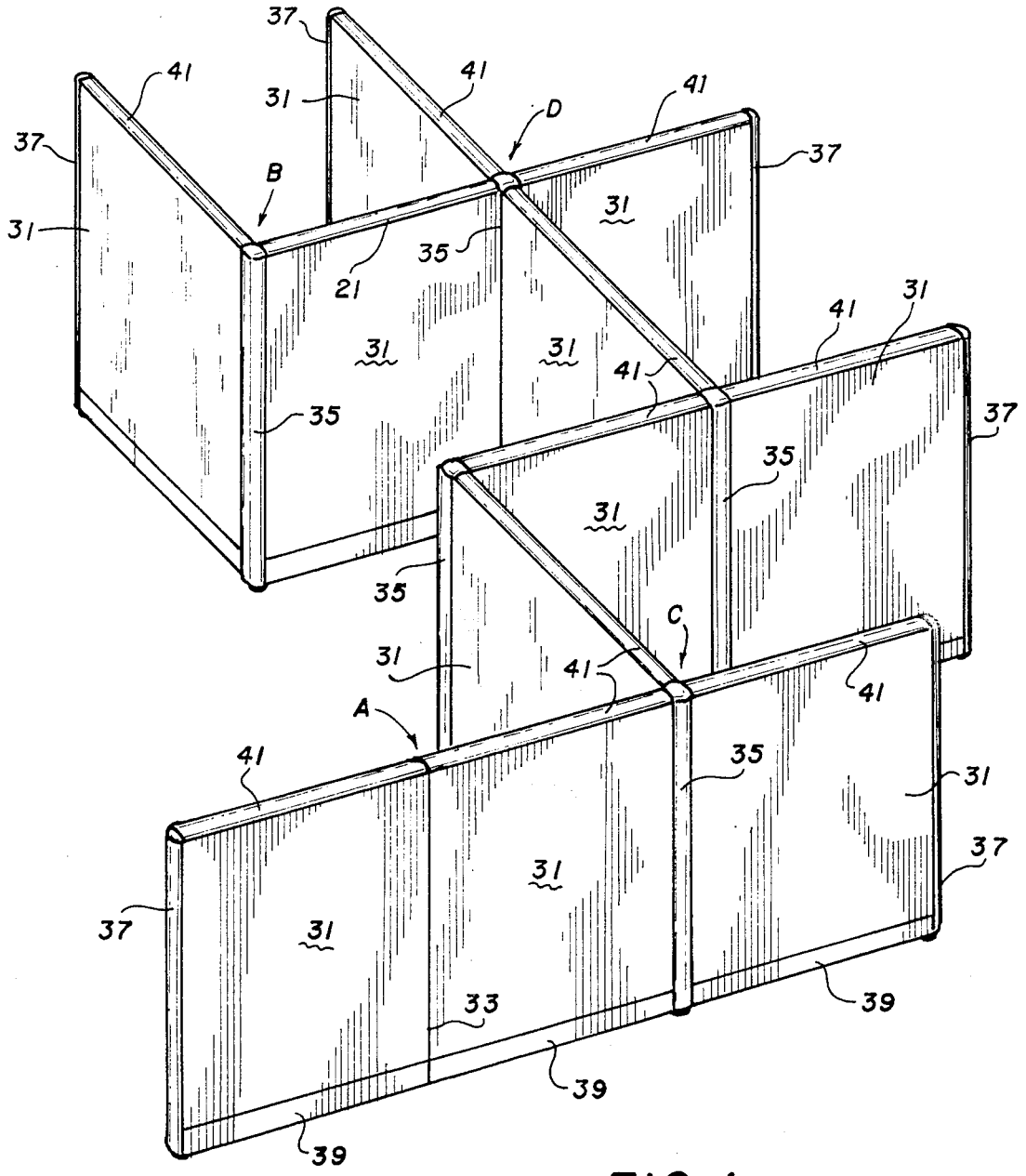
FIG. 1 is a perspective view of an assembled modular wall panel arrangement in accord with the present invention.

With reference to FIG. 1, a member of panel connections are shown. Arrow A indicates a panel-to-panel connection with the panel members 31 disposed in a straight line arrangement, the most common arrangement in modular wall panel assemblies. From a distance, the panels appear to be joined at a small seam 33. In actuality, the panels are separated slightly to allow brackets to slip into the seam 33. The brackets may be used to support a desk, a cabinet or a shelf.

Arrow B indicates a junction of two panel members 31 at right angles to each other. An intersection post 35 is used as a means for permitting angular dispositions. Arrow C shows an intersection post 35 at the junction of three panel members 31. Finally, Arrow D indicates a junction of four panel members.

Each panel member 31 which has an end not linked to another panel member or an intersection post 35 has an edge piece 37. Metal guards 39 at the bottom of each panel member protect any wiring and contribute to the aesthetically pleasing nature of the panel assembly. Cover pieces 41 are connected by quick connect and disconnect fasteners, such as Velcro pads, to the top edge of each panel member 31. Velcro is a registered trademark for fabric fasteners.

FIGS. 2 through 5 illustrate a connector post 43 which is used to link a panel member 31 to a second panel member, an intersection member 35, or an edge piece 37. The connector post 43 is a vertically slotted metallic post supported on an adjustable foot 45. The foot is affixed to a bolt 47 which is threaded into a foot fastener 49 in the leg 51 of the connector post. The leg 51 has a pedestal 55 which may serve as the area of rest in situations in which a foot 45 is not desirable.

Figure 2:
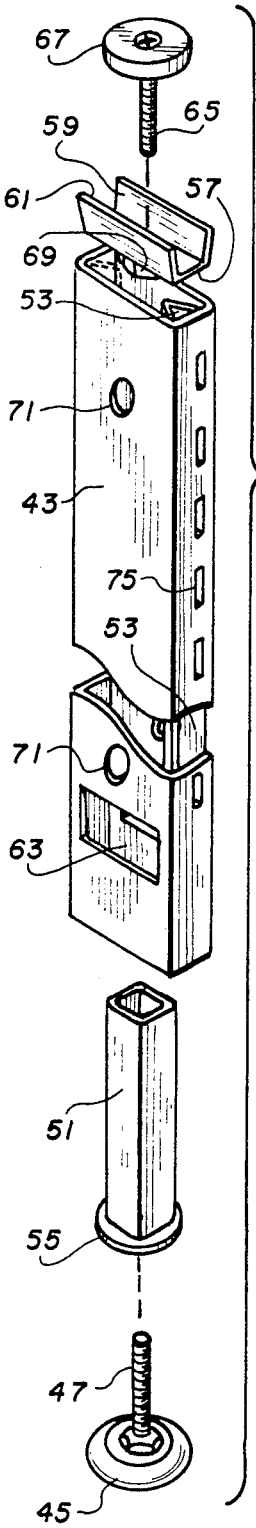
FIG. 2 is a perspective exploded view of a connector post of the wall panel arrangement of FIG. 1.
Figure 3:
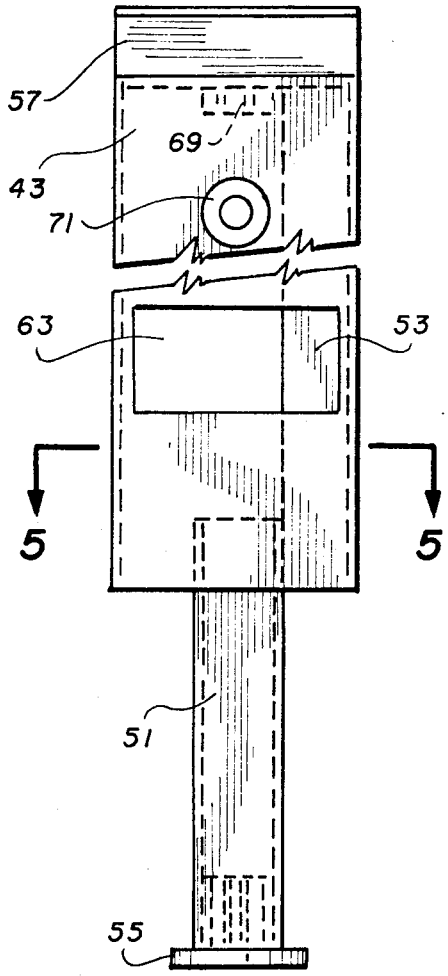
FIG. 3 is a side view of the post of FIG. 2, partially broken away.
Figure 4:
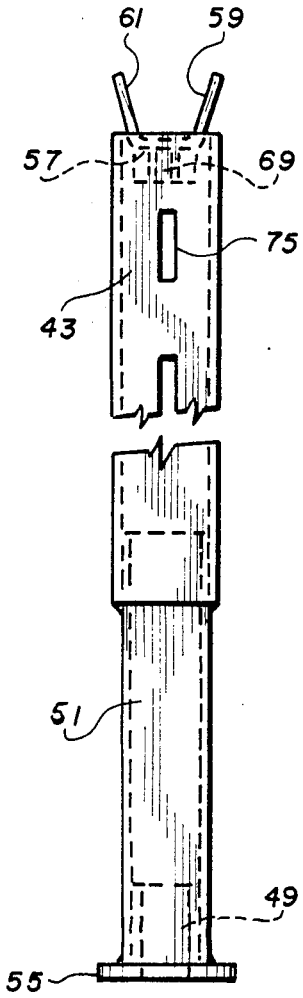
FIG. 4 is an end view of the post of FIG. 3, partially broken away.
Figure 5:
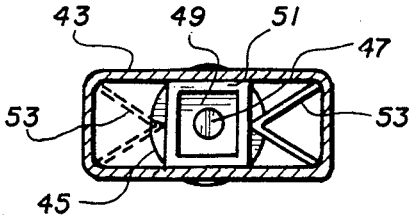
FIG. 5 is a top cross-sectional view of the post of FIG. 3 taken along lines 5—5.

Light shields 53, shown in FIGS. 2, 3 and 5, are disposed along the length of the connector post 43. The light shields 53 block light from traversing the post after entry into vertical slots provided in the post.

The U-shaped bracket 57 mounted atop the connector post 43 is a critical feature of the wall panel system. The bracket 57 has opposed upwardly extending inner surfaces 59, 61 over which an upper connector flange, not shown, of a panel member extends. Thus, it is the U-shaped brackets 57 which join adjacent panel members together by allowing them to hang from a connector post.

Connector post apertures 63 in the side walls of the connector post are aligned to engage lower connector flanges, not shown. After an upper and a lower connector flange have been placed onto a connector post, a washer and screw securing arrangement is employed to secure the engagement of the U-shaped bracket and the upper connector flange. FIG. 2 shows that the screw 65 passes through the washer 67 and is threaded into the bracket fastener 69. The connection between a panel member 31 and a connector post 43 will be described in greater detail below.

Figure 6:
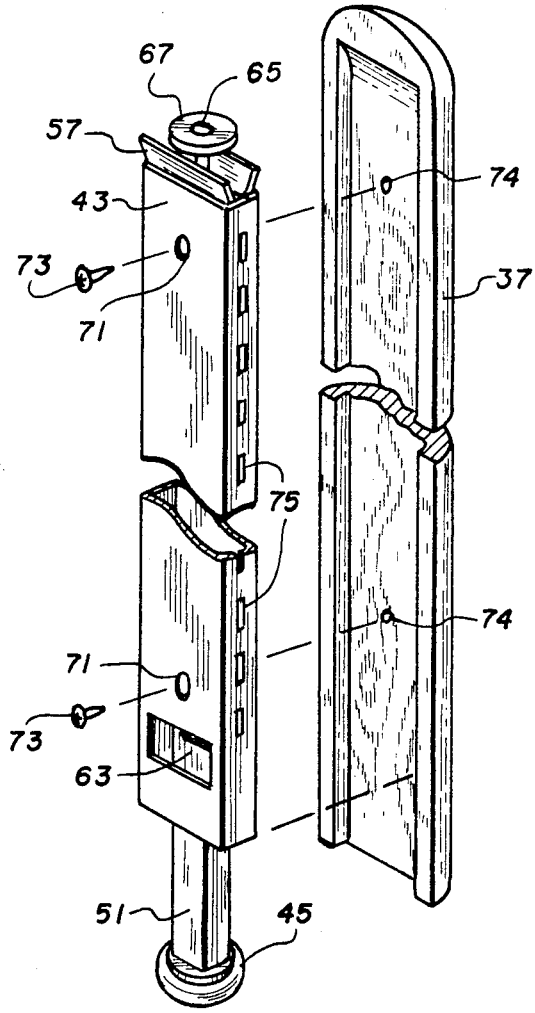
FIG. 6 is a perspective view of an edge member of FIG. 1.

Each side wall of a connector post 43 has a number of drill holes 71. These drill holes are used only when a connector post must be linked to an edge piece 37 at the start or end of a wall panel assembly. As can be seen in FIG. 6, wood screws 73 secure the edge piece 37 to a connector post 43. The drill holes 71 are positioned to allow the wood screws 73 to fit into edge piece holes 74.

The edge piece 37 and all other edge bandings are made of wood. Typically, the edge bandings are constructed of oak, walnut or mahogany. The height of the edge piece 37 is at least as great as the connector post and the edge piece is recessed to fit over the post. However, the depth of the recess does not permit the edge piece to cover the vertical slots 75. The linear array of vertical slots 75 along the connector post is left exposed so that the slots may be used to support the brackets, not shown, of cabinets, shelves, files, or desks in cantilever fashion. Such brackets have hooks or tangs which fit into the slots. The hooks are half-width, or slightly less, or alternatively the slots are double width, so that two side-by-side tangs can occupy one slot. This allows left and right ends of adjacent structures, such as shelves, to receive vertical support from a common post, as will be explained in greater detail with reference to FIGS. 22–24.

Figure 8:
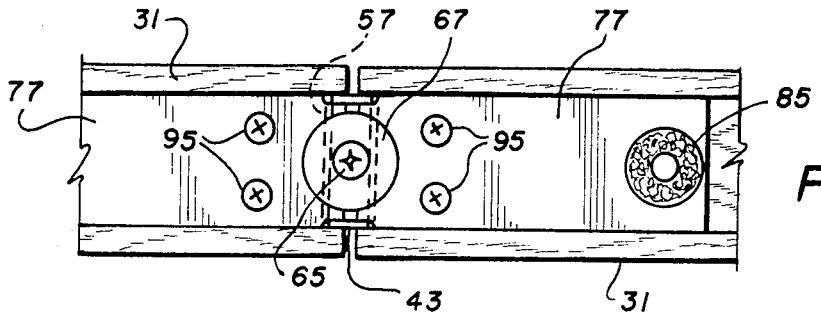
FIG. 8 is a top view of the panel junction of FIG. 7 taken along lines 8—8.
Figure 7:
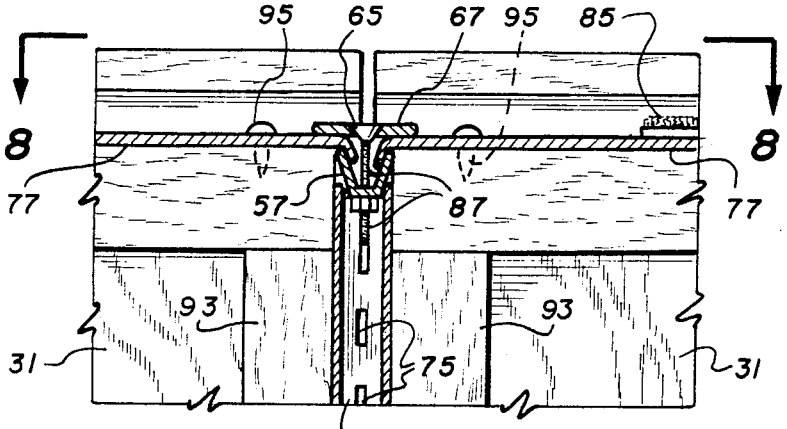
FIG. 7 is a front view of a two panel junction indicated by arrow A in FIG. 1, the view being partially broken away.
Figure 7:
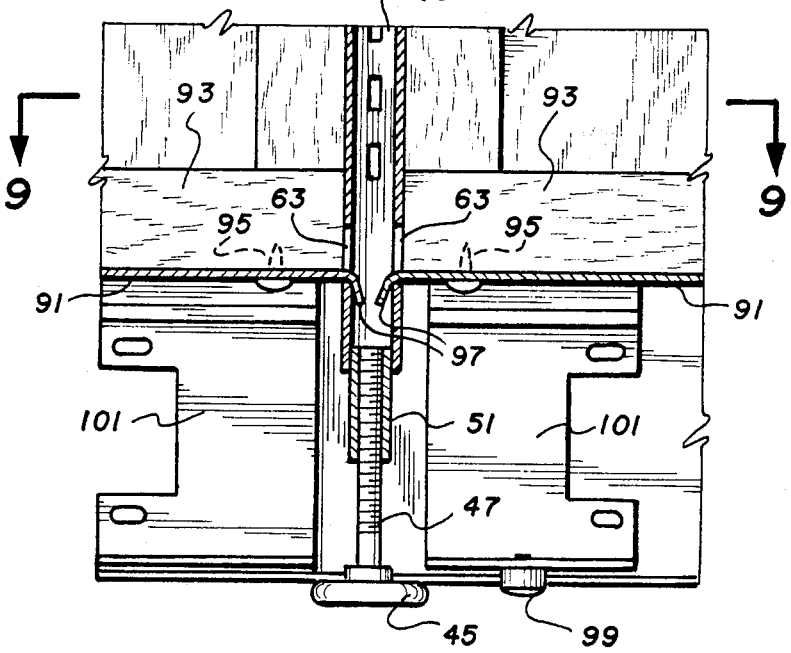
Figure 9:
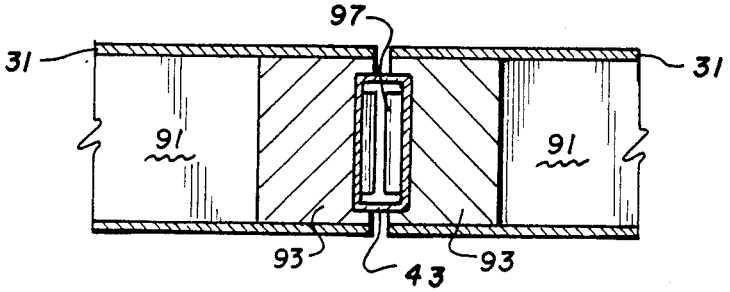
FIG. 9 is a top cross-sectional view of the panel junction of FIG. 7 taken along lines 9—9.
Figure 10:
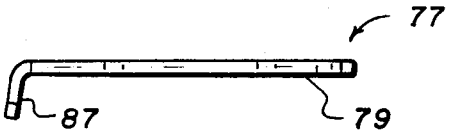
FIG. 10 is a side view of a connector flange of FIG. 7.
Figure 11:
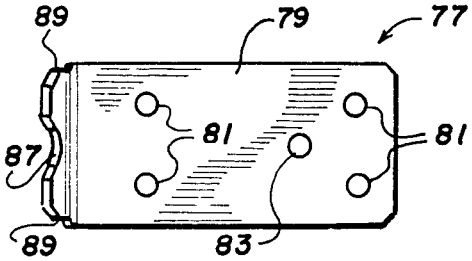
FIG. 11 is a bottom view of the flange of FIG. 10.

FIGS. 7–9 illustrate a planar connection of two panel members 31. The panel members each have an upper connector flange 77 which engages an inner surface of the U-shaped bracket 57 in an overlapping manner. The configuration of the connector flanges can be seen more clearly with reference to FIGS. 10–11. The connector flange 77 has a flat segment 79 which is fastened atop a panel member through four screw holes 81. A fifth screw hole 83 indicates the positioning of the Velcro button 85 of FIG. 7.

Connector flanges 77 have a downwardly extending segment 87. It is the downwardly extending segment which engages the inner surfaces of a U-shaped bracket 57. The segment 87 is comprised of two fingers 89 separated by a cut-away portion which facilitates passage of the washer and screw securing arrangement 65, 67.

Lower connector flanges 91 are attached to the bottom board of panel frame 93. Wood screws 95 hold the upper and the lower connector flanges to the frame 93. The configuration of the lower connector flange 91 is identical to that of the upper flange 77. Downwardly extending segments 97 gravitationally lock the lower connector flanges into the connector post apertures 63. Thus, the panel members 31 are linked together merely by simultaneously lifting the upper connector flange 77 over the U-shaped bracket 57 and slipping the lower connector flange 91 into the connector post aperture 63. When the panel member is released, the downwardly extending segments 87,97 of the flanges anchor the panel member against the connector post.

It is not critical that the securing arrangement comprise a screw 65 and a washer 67. Alternatively, the arrangement may be replaced by a custom screw having a large head or by a washer and screw which are spin-welded together. The washer 67 may be D-shaped at locations in which a connector post 43 partially fits into the recess of an edge piece 37, as shown in FIG. 6. A D-shaped washer is less likely to interfere with the connector post-edge piece connection.

Plastic button glides 99 at the base of the panel members protect the base during shipping and assembly. The button glides are attached to channels 101 which span the base of the panel members to retain wiring cables, not shown.

Figures 12, 13:
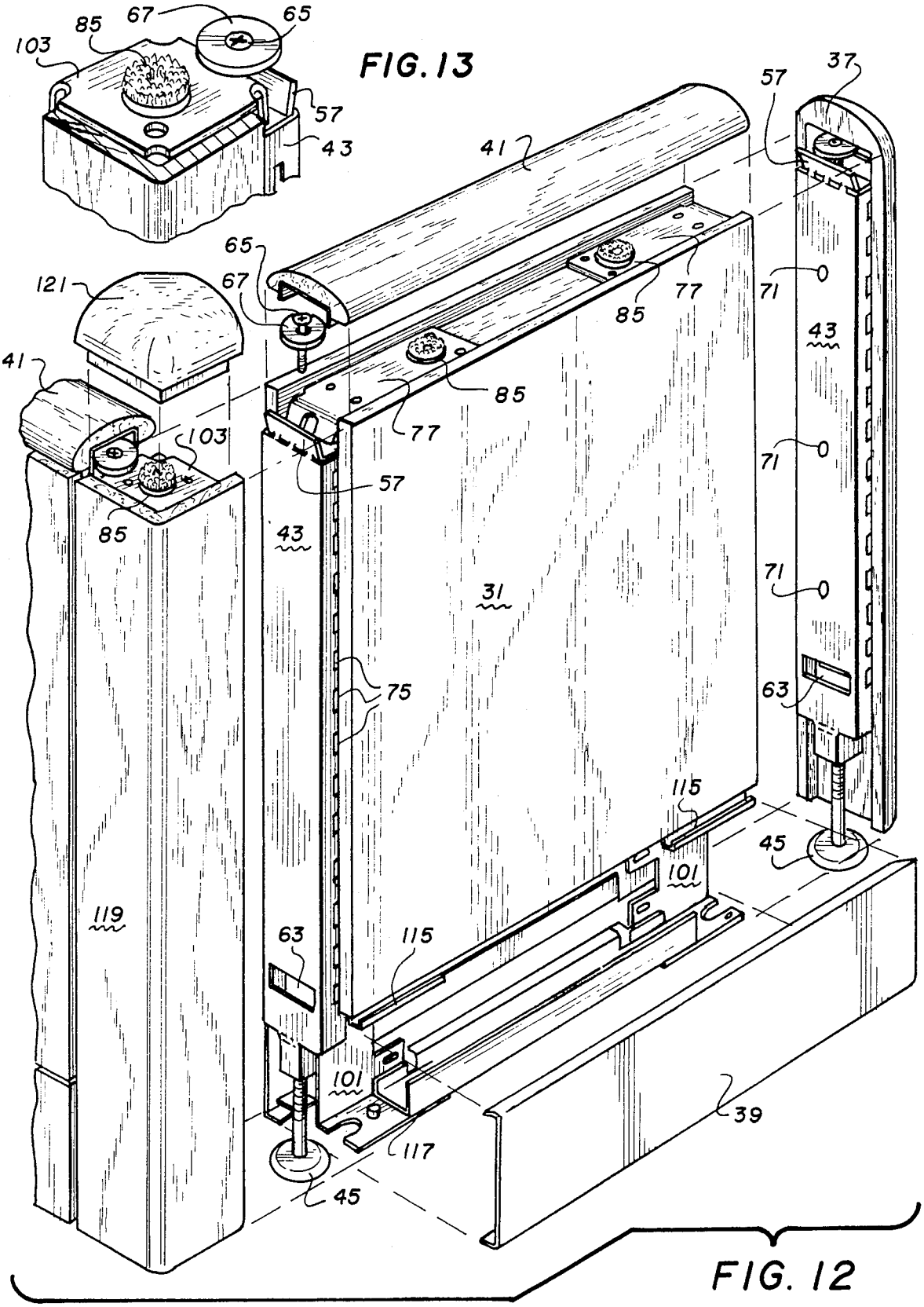
FIG. 12 is a perspective view of a corner junction indicated by arrow B of FIG. 1.
FIG. 13 is an enlarged perspective view of the corner junction of FIG. 12.
Figure 14:
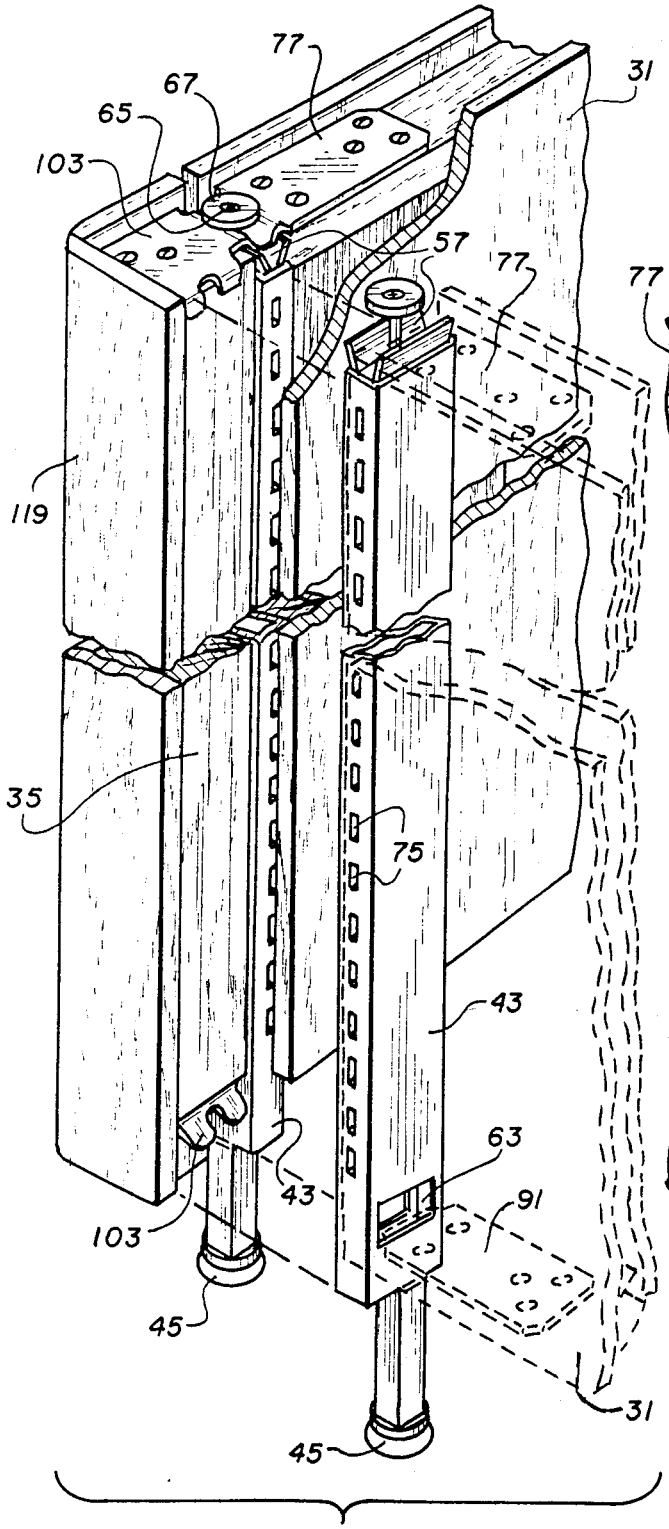
FIG. 14 is a perspective constructional view of the corner junction of FIG. 12.

FIGS. 12–14 illustrate the linkage of two panel members at right angles to each other. A panel member 31 is anchored to a connector post 43. The upper connector flange 77 overlaps an inner surface of the U-shaped bracket 57 and a lower connector flange 91 slips into a connector post aperture 63.

Figure 18:
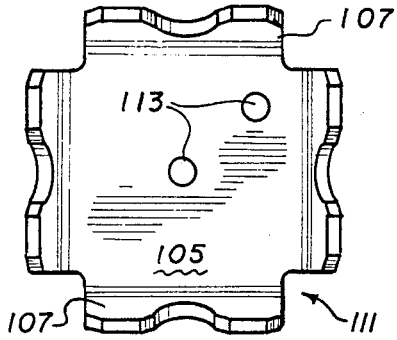
FIGS. 15, 16, and 18 are bottom views of alternate embodiments of an intersection flange shown in FIG. 13.
Figure 16:
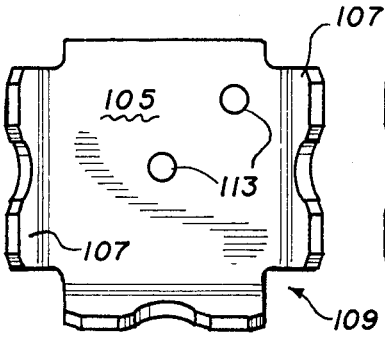
Figure 15:
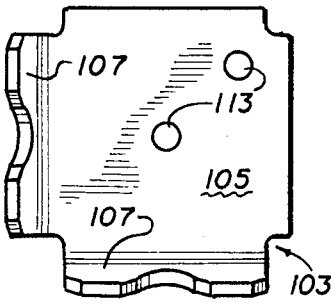
Figure 17:
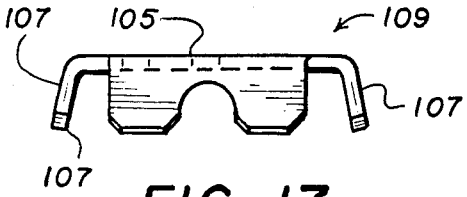
FIG. 17 is a side view of the flange of FIG. 16.

The connector post is joined to an intersection post 35 using the intersection flange 103 shown in FIG. 15. The intersection flange utilizes the same principles as the connector flanges 77, 91. An intersection flange has a flat segment 105 and at least two downwardly extending segments 107. The number of downwardly extending segments is determined by the number of connector posts 43 which must be joined to a particular intersection post 35. The downwardly extending segments 107 engage a U-shaped bracket 57 in the same way as a connector flange. FIGS. 16–17 illustrate an intersection flange 109 capable of engaging three connector posts. FIG. 18 shows an intersection flange 111 capable of joining four connector posts.

The various intersection flanges 103, 109, 111, are metallic. The flat segment 105 contains screw holes 113 so that the flanges may be secured to a wood intersection post 35, with one screw also securing a Velcro button 85 at the top of the intersection post.

A second intersection flange 103, identical to the first intersection flange, is affixed to the bottom of the intersection post 35. A downwardly extending segment of the second intersection flange slips into a connector post aperture 63 and gravitationally locks the two parts together. A washer and screw arrangement 65,67 holds the connector post 43 to the panel member 31 and to the intersection post 39.

Focusing on FIG. 12, after final assembly none of the connecting hardware is visible. The start or end of a wall panel assembly is covered by the edge piece 37. Velcro buttons, not shown, at the bottom of a cover piece 41 match the Velcro buttons 85 of the upper connector flanges in order to cap each panel member. A metallic guard 39 is pressure fit against extrusions 115 and the base 117 of the panel member.

Figure 19:
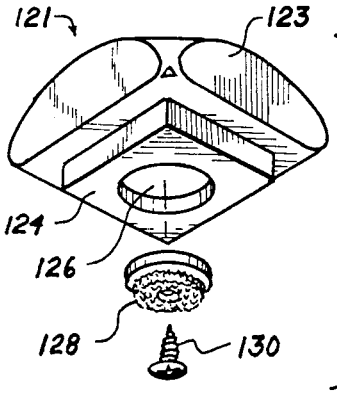
FIG. 19 is a perspective view of a corner cap of FIG. 12.

An intersection post cover 119 is fastened to the intersection post 35 by any of a number of means. The cover 119 may be held to the intersection post by adhesive, screws, slots along the intersection post or by the vertical slots 75 of the connector post. A corner cap 121 screens the intersection flange 103 from view. FIG. 19 shows that the cover cap 121 consists of large upper section 123 and a lower section 124 having dimensions corresponding to the intersection post. The lower section 124 has a recess 126 for a Velcro button 128 positioned to converge with the Velcro button 85 of the intersection connector 103. A screw 130 passes through the Velcro button 128 and into the wooden corner cap 121. All of the edge banding is made of matching wood.

Figure 20:
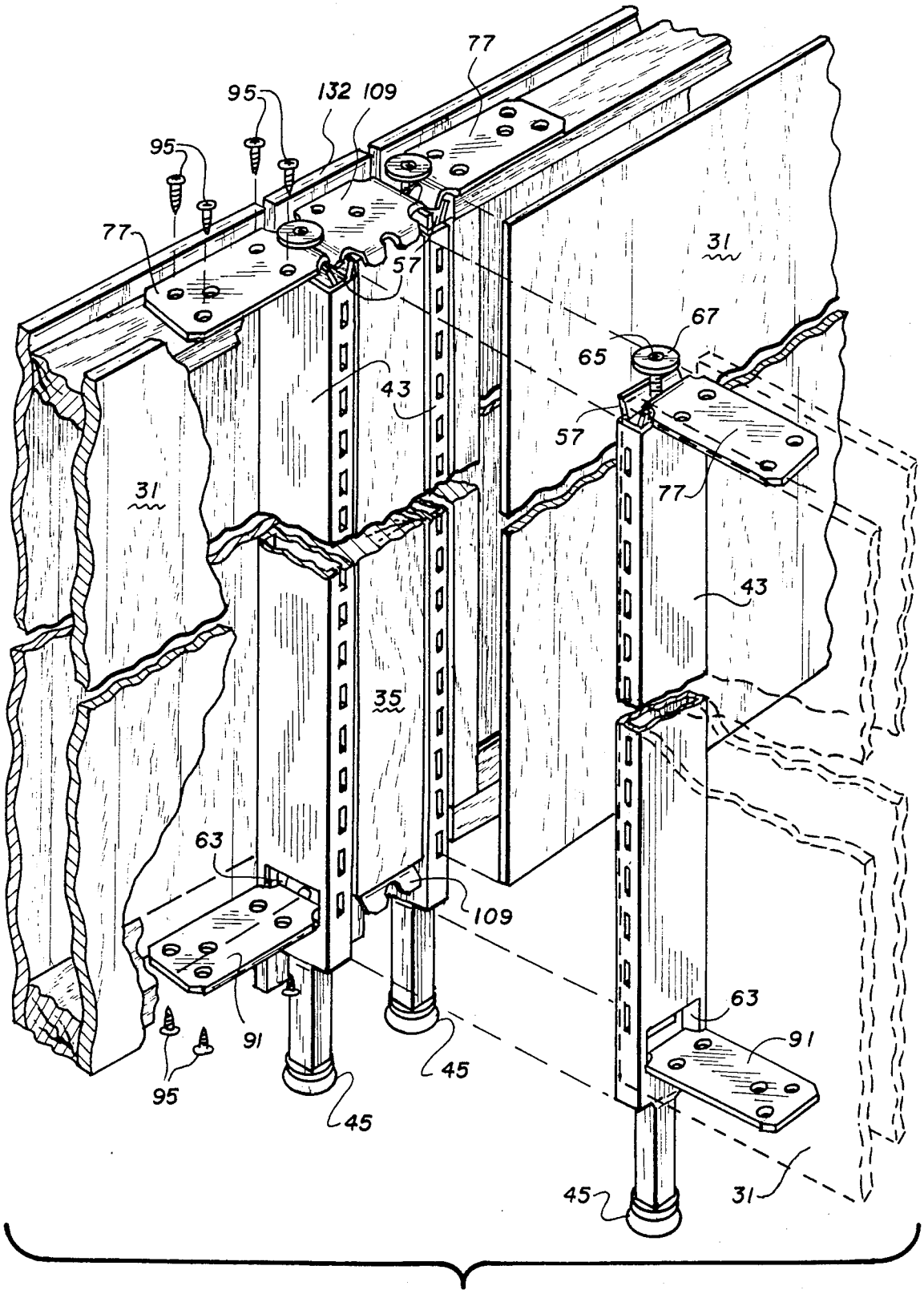
FIG. 20 is a perspective constructional view of a three panel junction indicated by arrow C of FIG. 1.

The three panel intersection of FIG. 20 is much like a two panel intersection. Any given panel member 31 is linked to a connector post 43 by connector flanges 77, 91. The connector posts are joined to the intersection flanges 109 of the intersection post. The upper intersection flange 109 has three downwardly extending segments, one to fit each U-shaped bracket 57. The intersection post cover 132 is an unbent cover but is fastened in the same manner as the cornered post cover 119 in the two panel intersection arrangement of FIG. 12.

Figure 21:
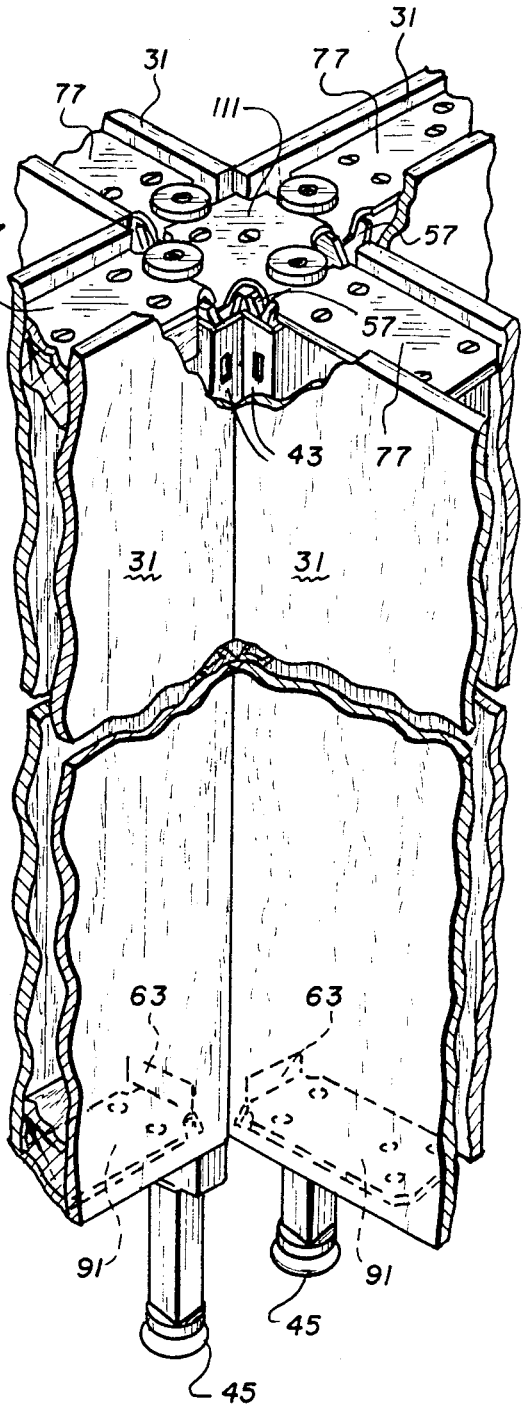
FIG. 21 is a perspective view of a four panel junction indicated by arrow D of FIG. 1.

FIG. 21 shows an intersection of four panel members 31. The upper intersection flange 111 has four downwardly segments with each segment overlapping an inner surface of a different U-shaped bracket 57. A lower intersection flange, not shown, also has four downwardly extending segments for engaging the apertures 63 of the connector posts 43. Once again, the connector posts 43 are attached to the panel members by means of connector flanges 77, 91.

Figure 22:
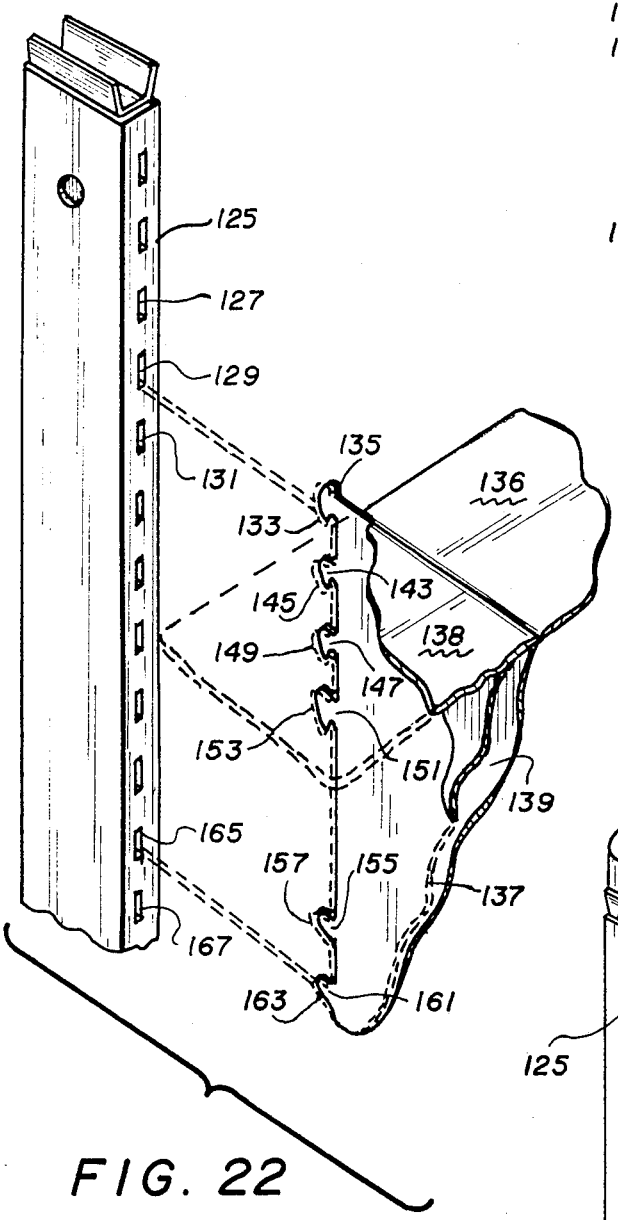
FIG. 22 is a perspective view of the upper portion of a connector post employed in the apparatus of the present invention and a broken away portion of a pair of adjacent brackets and fixtures having adjacent pairs of hooks fitting into slots within the post.

With reference to FIG. 22, upright post 125 is seen to have a vertical array of slots, including slots 127, 129, 131 and so on. These slots have a width dimension which is suitable for receiving two adjacent fixture bracket hooks 133 and 135. For example the width of a bracket slot may be on the order of slightly more than one-eighth inch wide. Each of the bracket hooks is on the order of slightly less than one-sixteenth inch wide. The two hooks will fit into a single slot. The height of each slot is approxiamtely one-half inch high. Hook 133 is associated with a fixture bracket 137 while hook 135 is associated with a fixture bracket 139. Each of these brackets has other downwardly extending hooks which serve to stabilize the bracket with respect to the post. For example, the pairs of hooks 143, 145; 147, 149; and 151, 153 are all pairs of adjacent hooks which fit into corresponding slots directly below slot 131 in connector post 125. Other members which resemble hooks, but do not have hook-like indentations, such as members, 155, 157 and 161, 163 fit into slots 165 and 167 for the purpose of stabilizing the brackets. The brackets 137 and 139 support respective furniture fixtures 136 and 138 in side-by-side relation, with the left hand edge of fixture 136, a shelf, abutting the right hand edge of fixture 138, another shelf member. The brackets 137, 139 are fastened to the undersides of the fixtures in a conventional shelf support manner.

Figure 23:
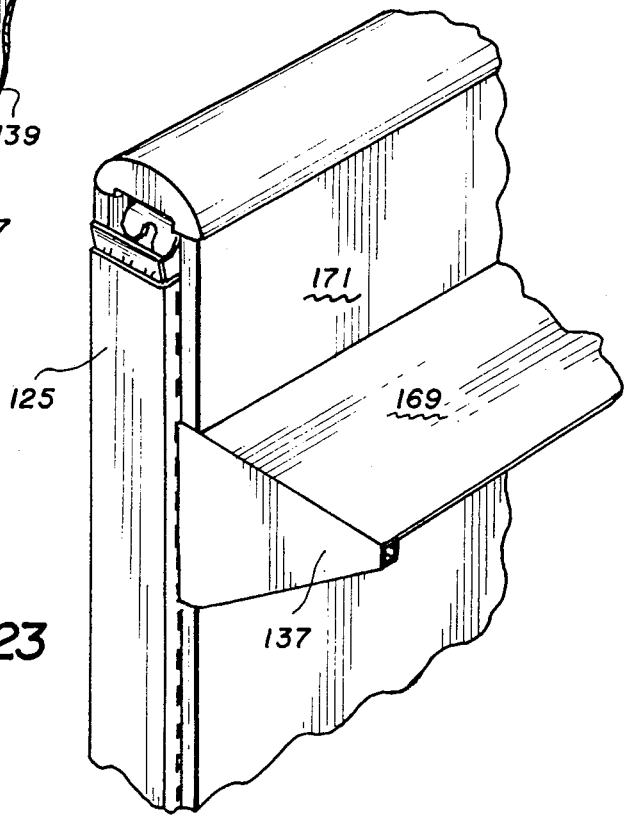
FIG. 23 is a perspective view of a single connector post, with a panel and fixture mounted thereto.

In FIG. 23, bracket 137 may be seen to be generally triangular in shape, with hooks and similar members fully inserted into connector post 125. Bracket 137 serves to cantilever a furniture fixture, such as shelf 169 directly adjacent to panel 171. A second adjacent bracket 139 of FIG. 22 is not shown, but such a bracket would be mounted adjacent to bracket 137 and have hooks fitting into the same slots as those of bracket 137.

Figure 24:
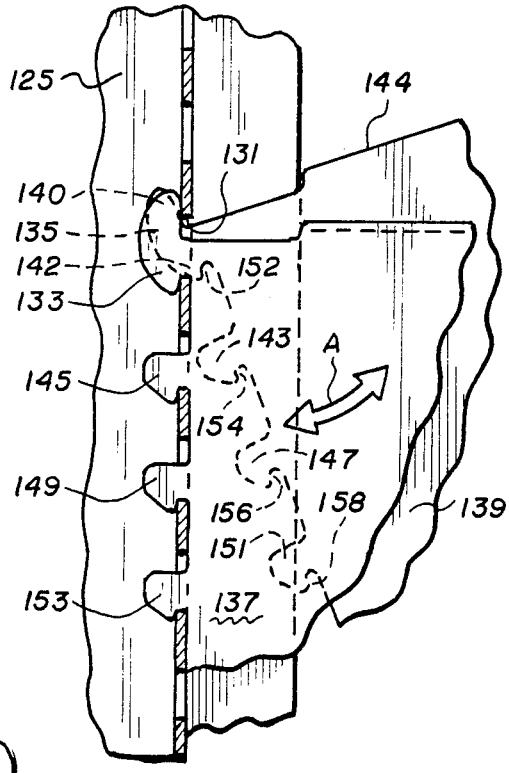
FIG. 24 is a side cutaway view showing insertion of a fixture bracket into slots within a post.

In FIG. 24, portions of brackets 137 and 139 are shown with respect to slots in connector post 125. In particuular, hooks 133, 145, 149, and 153 of bracket 137 are shown to be seated in respective slots. The construction of hooks may be seen with respect to bracket 139 where hook 135 is seen to have an upper 140 and a lower portion 142, with a vertical dimension which is longer than that of the elongate dimension of a slot. This construction for the uppermost hook, with the vertical hook dimension being about seven-eights of an inch, i.e. almost twice the vertical dimension of a slot, requires that the bracket be inserted with the upper bracket edge 144 almost vertical so that the upper hook portion 140 may be guided into slot 131. Once the upper portion is inserted into the slot, the bracket may be rotated in the direction of arrow head A and the lower portion 142 is pivoted into place. During this pivoting, hooks 143, 147 and 151 will be guided into place adjacent to hooks 145, 149 and 153 respectively. As the bracket is rotated, upon reaching insertion of the hooks into respective slots, the bracket drops slightly allowing downward facing indentations 152, 154, 156 and 158 to fall slightly downwardly, catching the bottom of each slot, thereby locking the bracket to the post. With two brackets mounted to each post, left and righthand edges of fixtures are mounted to a single post, in cantilever fashion, with weight transmitted downwardly through the post to a support surface.

One of the benefits derived from the rotational disengagement method for brackets, described above, is that by changing the design of only one hook, the top one, the possibility of accidental bracket disengagement is eliminated. To remove a bracket, full upward rotation and outward pulling is required. Similarly, panels having edges mounted to the connector post, also transfer weight for direct vertical support by connector post. The slots shown in FIG. 24 may exist on front and back sides of a connector post so that fixtures may be supported from both sides of a post.

Panel systems of the present invention are easy to assemble and aesthetically pleasing. More importantly, the single load-bearing connector posts between coplanar panels give the system unusual strength and stability.

We claim:

1. A modular wall panel system comprising, a plurality of upright load-bearing connector posts in contact with a support surface, each post having opposed side walls and opposed front and back walls, a plurality of vertically extending bracket slots defined in at least one of the front and back walls and at least one panel registration slot defined in each of the opposed lateral walls, a plurality of rectangular panels having opposed lateral edges, each of said edges having post engaging means extending therefrom for gaining support for each panel between side walls of two connector posts at a height clearing said support surface, said post engaging means including at least one cantilevered flange extending from the associated lateral edge for engagement with a panel registration slot of a connector post, said opposed lateral edges of each panel wrapping around almost half of said connector posts, except for said vertically extending bracket slots, thereby substantially concealing said bracket slots, some of said post engaging means cooperatively entering panel registration slots in said connector posts, whereby each panel is elevated and supported between two adjacent posts, and a plurality of wall panel modular fixtures having cantilever brackets, each cantilever bracket having hooks engaging said vertically extending bracket slots, supporting said fixtures from said connector posts in cantilever fashion, the width of each hook being less than half the slot width so that two adjacent hooks may fit in one slot for side-by-side support of wall panel modular fixtures.

2. The modular wall panel system of claim 1 wherein each upright post includes a downwardly extending adjustable foot contacting said support surface, said foot comprising a load bearing rod in vertical alignment with the bracket slots wherein loads transmitted onto the post through the bracket slots are conveyed vertically downwardly.

3. The modular wall panel system of claim 1 wherein at least two panels are disposed in a right angle relation, each of said panels laterally engaging the side walls of a different connector post, said connector posts joined to a non load-bearing intersection post having a rectangular cross section.

4. The modular wall panel system of claim 3 wherein first and second panels are disposed in a right angle relation and a third panel is disposed coplanar with one of said first and second panels, but on an opposite side of said intersection post, with the panel laterally engaging a side wall of a connector post which, in turn, is joined to said intersection post.

5. The modular wall panel system of claim 3 wherein first and second panels are disposed in a right angle relation and third and fourth panels are disposed respectively coplanar with said first and second panels, but on opposite sides of said intersection posts, with each panel laterally engaging a side wall of a connector post which, in turn, is joined to said intersection post.

6. A modular wall panel system comprising, a plurality of rectangular panel members, a plurality of upright load-bearing connector posts in contact with a support surface, each having side walls and having spaced apart front and back walls, said side walls having means for laterally engaging rectangular panel members, said front wall having a first vertical array of slots defined therein of uniform width, at least a pair of panel members being disposed in coplanar relation supported by opposite side walls of a connector post each panel member having spaced apart forward and rearward walls extending over a portion of a connector post front and back wall, respectively, and a plurality of wall panel modular fixtures provided with cantilever bracket members supported adjacent said panel members, at least a pair of said modular fixtures disposed in side-by-side relations, said bracket members having hooks with a width not exceeding half the width of a slot, whereby said bracket members are cantilevered by the hooks from said connector posts, with adjacent bracket members of side-by-side modular fixtures having hooks sharing the same slot in a connector post, there being only one connector post between coplanar panel members.

7. The modular wall panel system of claim 6 wherein said back wall has a second vertical array of slots and each rectangular panel member has side edges which partially wrap around said upright rectangular posts except over said first and second vertical arrays of slots, which are exposed.

8. The modular wall panel system of claim 6 wherein said hooks comprise segments projecting from an edge of a furniture bracket member, the segments having a downwardly open indentation forming a hook, the uppermost segment having an upwardly extending tab, the tab and hook portions of the uppermost segment exceeding the vertical dimension of a slot, thereby serving to lock the bracket in place in said slot.

9. The modular wall panel system of claim 6 wherein at least two panels are disposed in a right angle relation, each of said panels laterally engaging the side walls of a different connector post, said connector posts joined to a non load-bearing intersection post having a rectangular cross section.

10. The modular wall panel system of claim 9 wherein first and second panels are disposed in a right angle relation and a third panel is disposed coplanar with one of said first and second panels, but on an opposite side of said intersection post, with the panel laterally engaging a side wall of a connector post which, in turn, is joined to said intersection post.

11. The modular wall panel system of claim 9 wherein first and second panels are disposed in a right angle relation and third and fourth panels are disposed respectively coplanar with said first and second panels, but on opposite sides of said intersection posts, with each panel laterally engaging a side wall of a connector post which, in turn, is joined to said intersection post.

12. The modular wall panel system of claim 6 wherein each connector post comprises a main body portion defining said slots, said main body portion having a vertical extent generally coextensive with the vertical extent of a panel member, a tubular leg below said main body portion and connected thereto, and a foot in contact with said support surface, said foot being adjustably connected to said leg.

13. The modular wall panel system of claim 12 wherein said tubular leg includes a threaded portion and said foot includes a threaded shank screwing into said threaded portion thereby forming an adjustable connection.

14. A modular wall panel system comprising, a plurality of rectangular panel members, each having opposed lateral edges and having forward and rearward walls spaced apart by a panel frame, each panel member further having an upper and a lower cantilevered flange extending from each lateral edge, a plurality of upright, load-bearing connector posts in contact with a support surface, each connector post having spaced apart side walls and spaced apart front and back walls, said side walls each having a panel registration slot disposed to received a lower cantilevered flange of a panel member, said connector posts each having a panel supporting means for cooperative engagement with said upper cantilevered flanges, said front walls of the connector posts each having a vertical array of elongated slots defined therein, a first pair of panel members being disposed in coplanar relation and supported at opposite side walls of a connector post by said upper and lower cantilevered flanges, said forward and rearward walls of said first pair of walls extending beyond the lateral edges of the panel members to substantially cover said front and back walls of the connector posts, except for said vertical array of elongated slots, at least one non load-bearing intersection post, a second pair of panel members being disposed in right-angle relation, each engaging a side wall of different connector posts which are joined to an intersection post, and a plurality of wall panel modular fixtures provided with cantilevered bracket members supported adjacent said panel members, said cantilever bracket members having a plurality of vertically aligned hooks spaced apart at intervals matching the intervals of the vertical array of elongated slots of said connector posts, the hooks defined by a segment projecting from an edge of a cantilever bracket member with a downwardly open indentation for engaging an elongated slot, the uppermost hook having an upwardly extending tab, the tab and segment of the uppermost hook exceeding the elongate dimension of an elongated slot, said hooks having a width not exceeding the width of an elongated slot, whereby adjacent modular fixtures have hooks sharing the same slots of a connector post.

15. The modular wall panel system of claim 14 wherein said panel supporting means for cooperative engagement of the upper cantilevered flange includes a U-shaped bracket fixed atop each connector post, said upper cantilevered flanges having a downwardly extending segment for engagement with the U-shaped bracket.

* * * * *